US010227795B1

(12) United States Patent
Weldon

(10) Patent No.: US 10,227,795 B1
(45) Date of Patent: Mar. 12, 2019

(54) GATE LATCH

(71) Applicant: Weldon Industries, Inc., Tampa, FL (US)

(72) Inventor: Mark Weldon, Tampa, FL (US)

(73) Assignee: THE GOVERNOR AND COMPANY OF THE BANK OF IRELAND, AS COLLATERAL AGENT, Stamford, CT (US)

( * ) Notice: Subject to any disclaimer, the term of this patent is extended or adjusted under 35 U.S.C. 154(b) by 493 days.

(21) Appl. No.: 14/730,724

(22) Filed: Jun. 4, 2015

Related U.S. Application Data

(60) Provisional application No. 62/008,224, filed on Jun. 5, 2014.

(51) Int. Cl.
*E05B 65/00* (2006.01)
*E05C 3/12* (2006.01)

(52) U.S. Cl.
CPC ..... *E05B 65/0007* (2013.01); *E05C 3/12* (2013.01)

(58) Field of Classification Search
CPC ..... E05B 65/0007; E05C 3/12
USPC ..... 292/219, 220, 230, 231, 238
See application file for complete search history.

(56) References Cited

U.S. PATENT DOCUMENTS 2,310,348 A * 2/1943 Blears ..... E05C 3/043 292/202
4,178,025 A * 12/1979 Robins ..... E05C 3/14 292/117
4,451,072 A * 5/1984 Petty, Sr. ..... E05C 3/14 292/104
4,690,440 A * 9/1987 Rogers ..... E05B 65/0007 292/205
4,871,203 A * 10/1989 Rogers ..... E05C 3/14 292/104
4,887,854 A * 12/1989 Bulten ..... E05C 3/14 292/104
5,104,163 A * 4/1992 Palmer, Jr. ..... E05B 63/24 292/148
5,897,148 A * 4/1999 Arabia, Jr. ..... E05B 85/243 292/209
5,967,572 A * 10/1999 Sajfert ..... E05B 17/0012 292/336.3
6,176,043 B1 * 1/2001 Gibbs ..... E05B 9/08 49/449
6,471,261 B1 * 10/2002 Messier ..... E05B 65/0007 292/205
6,898,953 B1 * 5/2005 Paprocki ..... E05B 13/002 292/285

(Continued)

FOREIGN PATENT DOCUMENTS

GB 2090902 A * 7/1982 ..... B25J 15/00

*Primary Examiner* — Carlos Lugo
(74) *Attorney, Agent, or Firm* — Christopher Paradies; Paradies Law P.A.

(57) ABSTRACT

A gate latch comprises a pivot point formed by a bolt and a collar, the collar extending from a bottom plate and into the hole of a top plate. The bolt extends into the collar and retains the top plate on the collar and the bottom plate. For example, the gate latch includes a biasing mechanism, such as a spring, secured within a slot of the bottom plate and protected from accidental damage that could occur if the spring were more exposed. The latch may be reversible using a plate that can be flipped in either right or left opening.

16 Claims, 3 Drawing Sheets

(56) References Cited

U.S. PATENT DOCUMENTS

| | | | | |
|---|---|---|---|---|
| 7,311,339 | B2 * | 12/2007 | Lau | E05B 15/022 292/128 |
| 7,810,853 | B2 * | 10/2010 | Margheritti | E05B 81/25 292/216 |
| 8,678,451 | B2 * | 3/2014 | Martin | E05C 3/14 292/121 |
| 2010/0148523 | A1 * | 6/2010 | Tai | E05B 17/2038 292/236 |
| 2014/0125070 | A1 * | 5/2014 | Korzenioski | B60K 11/04 292/220 |

* cited by examiner

GATE LATCH

CROSS RELATED APPLICATIONS

This application claims priority to U.S. Prov. Appl. 62/008,224, which was filed Jun. 5, 2014.

FIELD OF THE INVENTION

The field relates to hardware for gates, specifically latches.

BACKGROUND

Post latches, such as the post latch 300 shown in FIG. 3, are known that have a pin 332, extending from a fixture 330, which fits in a void formed by a top plate 302 and a bottom plate 301, which are pivotably joined by a bolt 349 extending through a hole in the top plate and threadingly engaging a hole formed in the bottom plate. A spring 320 applies a bias force between the top plate 302 and the bottom plate 301, such that the top plate is biased in the closed position, as shown in FIG. 3.

The spring 320 functions acceptably and adds little to the cost of the post latch 300. The bolt 349 functions to both join the top and bottom plates together, as well as providing the pivot point between the top and bottom plates.

SUMMARY

A gate latch may comprise a pivot point between a top plate and a bottom plate formed by a collar extending from the bottom plate into a hole formed in the top plate. A bolt threadingly engages the collar, securing the top plate onto the collar and the bottom plate, such that the top plate is pivotally engaged on the bottom plate. In one example, a biasing mechanism is safely secured within a slot formed on the bottom plate, such that accidental damage to the spring is prevented. The biasing mechanism, such as a spring, may be attached at one end to the bottom plate and at the opposite end to the top plate, such that a bias force is applied.

For example, a gate latch comprises a pair of plates, stamped or formed of a sheet metal, such as by machining or the like. For example, a first one of the pair of plates may have holes machined through its surface for attaching the first one of the pair of plates to a gate or fence post with screws. For example, a pin attached opposite of the gate latch may be securely retained in a void between the pair of plates, when the pair of plates are assembled and fixed to a gate or fence post.

The gate latch comprises a biasing mechanism, such as a spring, attached between the pair of plates and disposed within a slot formed in one of the pair of plates, such that the void of the pair of plates is biased closed by the biasing mechanism.

A threaded insert is fixed in one of the pair of plates, such as by brazing, welding or friction stir welding.

The threaded insert has a flange having a thickness about the same as the plate in which the threaded insert is fixedly reatined, such that a surface of the flange does not extend above a surface of the plate in which the threaded insert is fixedly retained. An internally threaded portion extends above the surface of the flange, such that the internally threaded portion is disposed within a hole formed in the other one of the pair of plates, when the pair of plates are mated together.

For example, a bolt and a washer may be threadingly engaged with the internally threaded portion, such that the pair of plates are joined together by the threaded insert fixedly attached to one of the pair of plates, and the bolt passing through the hole in the other of the pair of plates. The pair of plates comprising a latching member, such that the latching member is formed in the first plate, the second plate or both the first plate and the second plate of the pair of plates.

The pair of plates may have, in one of the pair of plates, an integrally formed tab bent such that the tab extends out of the plane of the one of the pair of plates, and a slot in the other of the pair of plates, such that the tab extends through the slot, limiting the extend of pivoting of the pair of plates one to the other, such that the tab and slot form a stop and catch, the stop extending from the first plate or the second plate, the catch being formed in the first plate, if the stop extends from the second plate, or the second plate, if the stop extends from the first plate, the catch being aligned with the stop, such that the stop engages the catch, when the second plate pivots on the collar insert of the first plate, such that the range of pivoting motion is limited by the stop and catch. For example, a catch in the second plate may be formed by two slots disposed on opposite sides of the second plate.

In one example, a latch comprises a first plate and a second plate, wherein each of the first plate and the second plate are formed of flat metal plates, each defining a respective plane, the plane of the first plate defining a first plane and the plane of the second plate defining a second plane, and the first plate and the second plate are arranged such that the second plane is substantially parallel and adjacent the first plane, and the first plate has a collar insert permanently fixed to the first plate and extending above the first plane and into the second plane such that the collar insert extends into a hole formed in the second plate, the hole in the second plate having a defined diameter and a center point axially aligned with a cylindrical axis of the collar insert, and the collar insert extends as a cylinder beyond the plane of the first plate, having an outer diameter of the cylinder sized to matingly fit into the defined diameter of the second plate, and the cylinder is inserted into the hole in the second plate, such that the collar insert is pivotally retained within the hole of the second plate. A fastener, such as a bolt, may have a first end for engaging the collar insert, such as a threaded end, threadingly engaging a threaded hole bored and tapped in the collar insert, and a second end, opposite of the first end and on an opposite side of the second plate, the second end having a retaining member for pivotally retaining the second plate on the collar insert, such as a head shaped for matingly engaging a wrench or a screw driver. For example, a stop and catch may be provided, the stop extending from the first plate or the second plate, the catch being formed in the first plate, if the stop extends from the second plate, or the second plate, if the stop extends from the first plate, the catch being aligned with the stop, such that the stop engages the catch, when the second plate pivots on the collar insert of the first plate, such that the range of pivoting motion is limited by the stop and catch. A latching member may be formed in the first plate, the second plate or both the first plate and the second plate. A biasing mechanism may be provided that applies a biasing force between the first plate and the second plate, such that the latching member is biased in the closed position. For example, the biasing mechanism is a helical coil spring. In one example, the helical coil spring is retained on one end by the first plate and on an opposite end by the second plate, and the first plate, the second plate or both the first plate and the second plate protect the helical coil spring by enclosing the helical coil spring within a slot formed by the first plate, the second plate or both the first plate and the second plate. For example, the stop is a tab extending from the first plate or the second plate, and the catch may be a slot formed in the second plate, if the tab extends from the first plate, or the first plate, if the tab extends from the second plate. In one example, the stop is a tab that extends from the first plate, and the catch is a slot formed in the second plate.

In one example, a reversible plate is provided that is symmetric about a line of mirror symmetry, except for the latching member. For example, the stop is a tab extending from the first plate; and the biasing mechanism and latching member are arranged and connected such that the latching member is reversible from right hand closure to left hand closure or left hand closure to right hand closure by removing the biasing mechanism, loosening the fastener, flipping the second plate and replacing the fastener and reconnecting the biasing mechanism between the first plate and the second plate. For example, the biasing mechanism is a helical coil spring. For example, the helical coil spring is retained on one end by the first plate and on an opposite end by the second plate, and the first plate, the second plate or both the first plate and the second plate protect the helical coil spring by enclosing the helical coil spring within a slot formed by the first plate, the second plate or both the first plate and the second plate. The catch in the second plate may be formed by two slots disposed on opposite sides of the second plate.

A method of reversing a direction of closure of a reversible latch from right hand closure to left hand closure or left hand closure to right hand closure may be provided, for example, by detaching the biasing mechanism; loosening the fastener; flipping the second plate; replacing the fastener; and reconnecting the biasing mechanism between the first plate and the second plate.

A method of permanently fixing the collar insert in the first plate may be provided by selecting a collar insert having a flange extending outwardly in the plane of first plate from the outer diameter of the collar insert; forming a hole in the first plate having a diameter selected to fit the flange of the collar insert into the hole; and joining the flange of the collar insert to the hole in the first plate. For example, the step of joining may include brazing, welding or friction stire welding. In one example, the flange of the insert collar is welded in the first plate. For example, the step of welding may be friction stir welding. Alternatively, the flange of the insert collar may be brazed in the first plate.

BRIEF DESCRIPTION OF THE DRAWINGS

The following drawings are illustrative examples and do not further limit any claims that may eventually issue.

When the same reference characters are used, these labels refer to similar parts in the examples illustrated in the drawings.

DETAILED DESCRIPTION

Figure 3:
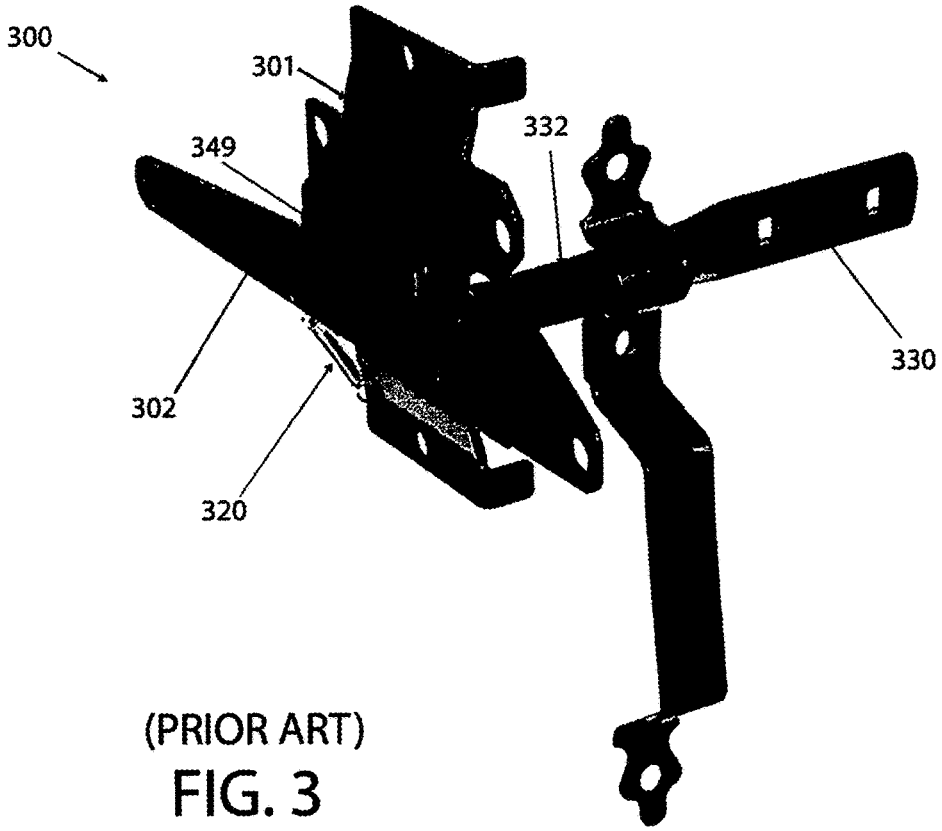
(PRIOR ART) FIG. 3
FIG. 3 is an illustration of a prior art gate latch.

For example, known gate latches, such as the gate latch shown in FIG. 3, have no collar to engage the bolt 349, and the bolt 349 threadingly engages the flat plate of the bottom plate, directly. The example shown in FIG. 3 is typical of known gate latches in that the spring 320 extends between the two plates of the post latch 300. No structure surrounds the spring 320, which is exposed to accidental damage, such as by snagging or the like.

Figure 1:
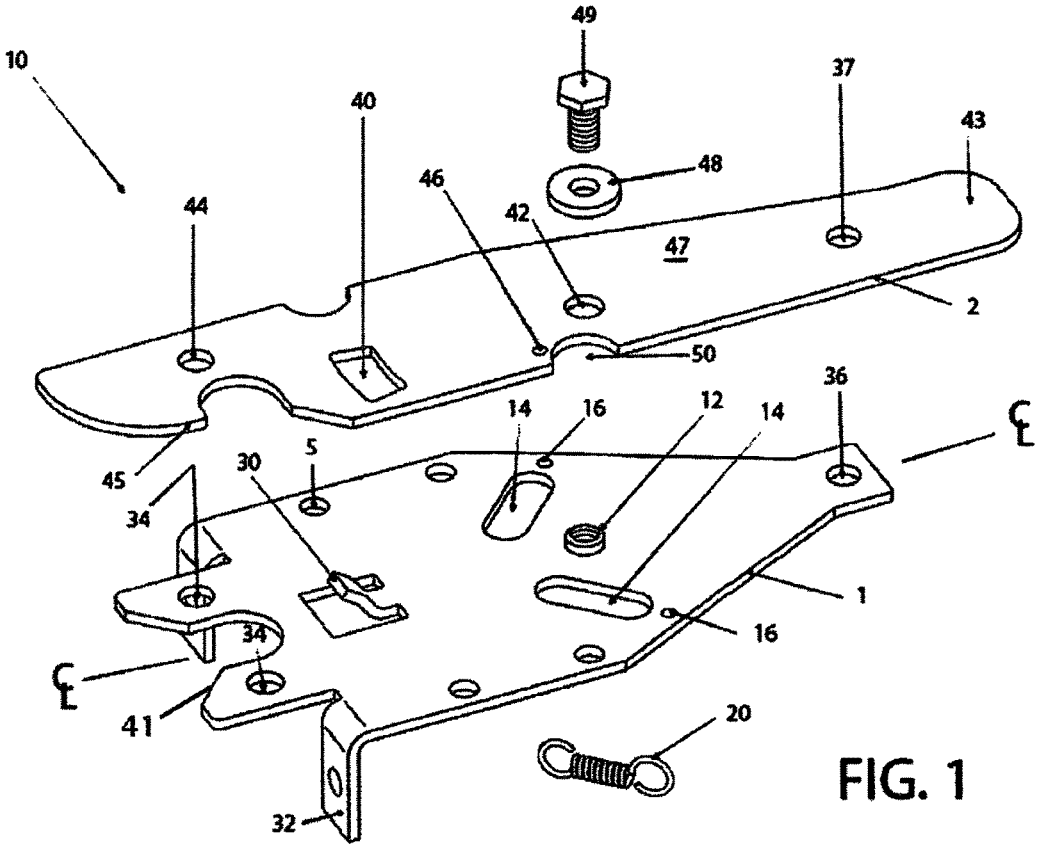
FIG. 1 is a top exploded view of a gate latch.
Figure 2:
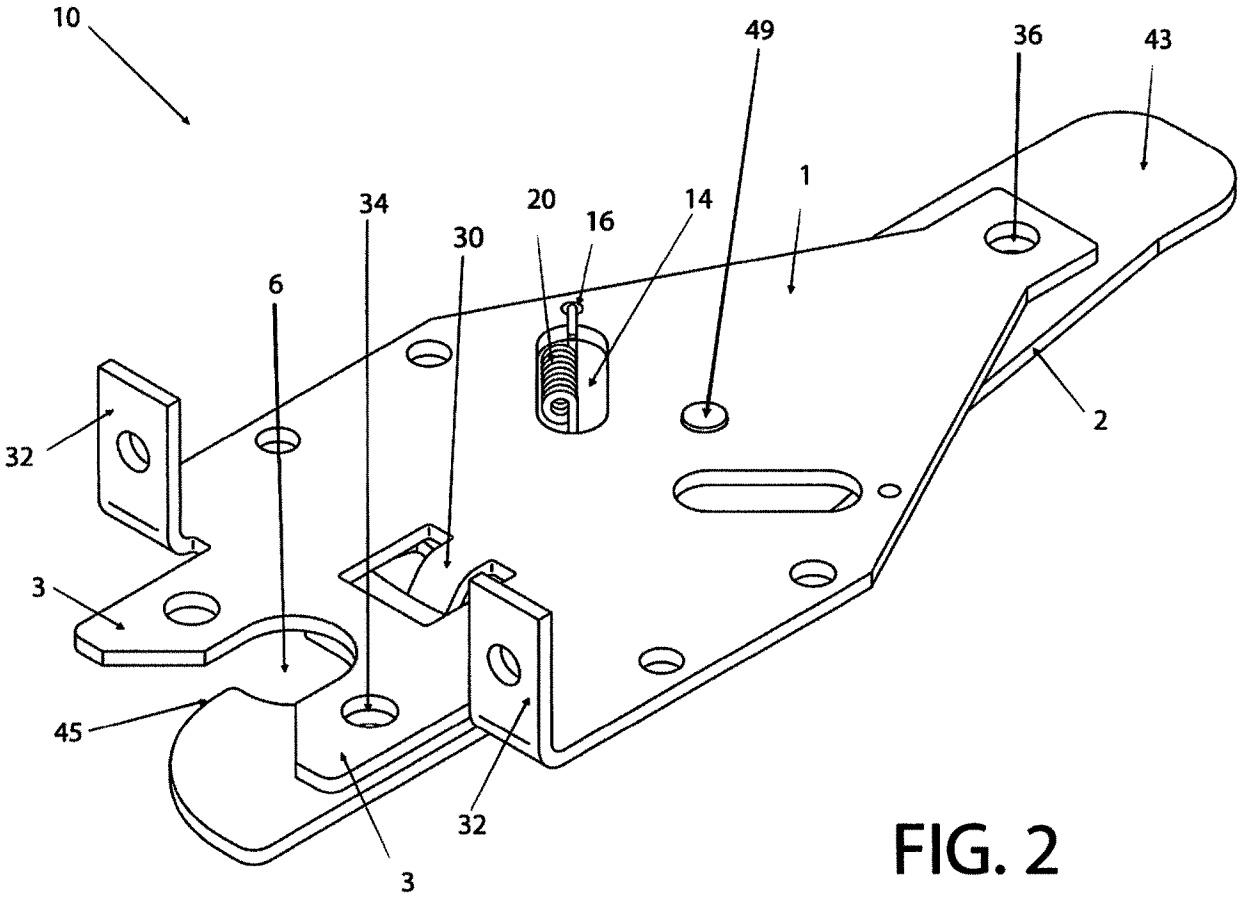
FIG. 2 is a bottom view of the gate latch of FIG. 1.

Surprisingly, the features of a gate latch 10 as illustrated in the example shown in FIGS. 1 and 2, provide a much more durable latch without adding substantial costs in the manufacturing of the gate latch. Improving durability without adding costs is both surprising and unexpected.

The example of FIG. 1 illustrates a gate latch 10 having a bottom plate 1 and a top plate 2, joined to the bottom plate by a bolt 49, with a washer 48 separating the head of the bolt 49 from an upper surface of the top plate 2. A hole 42 in the top plate 2 fits over a collar 12 extending upwardly from a surface of the bottom plate 1. The collar 12 may be formed integrally with a flange that is attached to the bottom plate 1 by brazing, welding, friction stir welding or other process capable of permanently affixing the collar 12 in the bottom plate 1. A latching member 41, 43, 45 may be formed in the first plate, the second plate or both the first plate and the second plate.

For example, the collar 12 comprises a threaded inner surface, such that the bolt 49 is threadingly engaged by the threaded inner surface of the collar 12, when the gate latch is assembled. It has been found, surprisingly, that the addition of the collar 12 provides a mechanical advantage to the joining of the top and bottom plates 1, 2, extending the useful life and durability of the gate latch compared to a gate latch without the collar. In one example, the bolt may be tack welded to the collar on a reverse side of the bottom plate 1. Alternatively, pairs of holes 36, 37 and 34, 44 may be provided in the top and bottom plates such that the gate latch may be secured by a cable and/or lock sets, capable of preventing the gate latch from being opened, even if the bolt 49 is removed from the gate latch. In this example, a tab 30 may be provided such that the top plate 2 may not be removed from the bottom plate 1, if a steal or cable lock is passed through the pairs of holes 36, 37 and 34, 44, even if the bolt 49 is removed from the collar 12, for example.

For example, the bottom plate 1 may be secured to a sliding gate or door by a plurality of screws fastening the bottom plate 1 to the gate or door through holes 5 formed through the thickness of the body of the bottom plate 1 and/or bent flanges 32 extending downwardly from the bottom plate 1.

From FIGS. 1 and 2, it may be seen that the illustrated example is reversible. That is, the top plate 2 may be oriented on the bottom plate 1 to open either to the left or the right. The bottom plate 1 has left and right symmetry about a centerline extending along the middle of the opening 6 for a pin, the tab 30 and the hole 36. All of the features on the left of the centerline 5, 14, 16, 32, 34 are mirrored on the right of the centerline. The spring 20 may be attached on one end at either of the two attachment points 16 of the bottom plate and on the other end to the attachment point 46 on the top plate, depending on whether the top plate 2 is attached as right opening or left opening, for example.

In the example of FIGS. 1 and 2, the spring 20 is inserted in a slot 14 on the bottom plate, such that the spring is protected from damage by being encompassed about a perimeter by the bottom plate 1. The top plate 2 has an arcuate cut-out 50 that prevents any impingement of the top plate 2 on the spring 20, when the top plate 2 is pivoted in relation to the bottom plate 1 within the entire range from its closed position to the fullest extent of pivoting allowed by the tab 30 and tab slot 40.

For example, as illustrated in FIG. 2, the tab 30 of the top plate extends through the slot 40 of the bottom plate.

limiting the extend of pivoting of the top plate 2 on the bottom plate 1, when the top plate 2 is joined to the bottom plate 1 by the bolt 49 being threadingly engaged in the collar 12 of the bottom plate 1 through the hole 42 of the top plate 2.

This detailed description provides examples including features and elements of the claims for the purpose of enabling a person having ordinary skill in the art to make and use the inventions recited in the claims. However, these examples are not intended to limit the scope of the claims, directly. Instead, the examples provide features and elements of the claims that, having been disclosed in these descriptions, claims and drawings, may be altered and combined in ways that are known in the art.

What is claimed is:

1. A latch comprises:

a first plate; and a second plate, wherein each of the first plate and the second plate are formed of flat metal plates, each defining a respective plane, the plane of the first plate defining a first plane and the plane of the second plate defining a second plane, and the first plate and the second plate are arranged such that the second plane is substantially parallel and adjacent the first plane, and the first plate has a collar insert permanently fixed to the first plate and extending above the first plane and into the second plane such that the collar insert extends into a hole formed in the second plate, the hole in the second plate having a defined diameter and a center point axially aligned with a cylindrical axis of the collar insert, and the collar insert extends as a cylinder beyond the plane of the first plate, having an outer diameter of the cylinder sized to matingly fit into the defined diameter of the second plate, and the cylinder is inserted into the hole in the second plate, such that the collar insert is pivotally retained within the hole of the second plate;

a fastener, the fastener having a first end for engaging the collar insert and a second end, opposite of the first end and on an opposite side of the second plate, the second end having a retaining member for pivotally retaining the second plate on the collar insert;

a stop and catch, the stop extending from the first plate or the second plate, the catch being formed in the first plate, if the stop extends from the second plate, or the second plate, if the stop extends from the first plate, the catch being aligned with the stop, such that the stop engages the catch, when the second plate pivots on the collar insert of the first plate, such that the range of pivoting motion is limited by the stop and catch;

a latching member formed in the second plate; and a biasing mechanism applying a biasing force between the first plate and the second plate, such that the latching member is biased in the closed position, and wherein the first plate comprises a mirror symmetry about a longitudinal centerline such that features on the left of the centerline are mirrored on the right of the centerline, on the opposite side of the centerline, and the features on the left side of the centerline comprise a left slot and a left attachment point, and the features on the right side of the centerline comprise a right slot and a right attachment point, such that when the biasing mechanism is attached at the left attachment point, the biasing mechanism is protectively disposed within the left slot and when the biasing mechanism is attached at the right attachment point, the biasing mechanism is protectively disposed within the right slot, whereby the latching member is reversible from left to right by removing the biasing mechanism from the left side, loosening the fastener, reversing the second plate, replacing the fastener, and connecting the biasing mechanism between the first plate and the second plate using the attachment point and slot on the right side of the centerline.

2. The latch of claim 1, wherein the biasing mechanism is a helical coil spring.

3. The latch of claim 2, wherein the helical coil spring is retained on one end by the first plate and on an opposite end by the second plate.

4. The latch of claim 3, wherein the stop is a tab extending from the first plate or the second plate.

5. The latch of claim 4, wherein the catch is a slot formed in the second plate, if the tab extends from the first plate, or the first plate, if the tab extends from the second plate.

6. The latch of claim 5, wherein the tab extends from the first plate.

7. The latch of claim 1, wherein the stop is a tab extending from the first plate or the second plate.

8. The latch of claim 7, wherein the catch is a slot formed in the second plate, if the tab extends from the first plate, or the first plate, if the tab extends from the second plate.

9. The latch of claim 8, wherein the tab extends from the first plate.

10. The latch of claim 1, wherein the stop is a tab extending from the first plate.

11. The latch of claim 10, wherein the biasing mechanism is a helical coil spring.

12. A method of reversing a direction of closure of the latch of claim 10 from right hand closure to left hand closure or left hand closure to right hand closure, the method comprising:

detaching the biasing mechanism;

loosening the fastener;

flipping the second plate;

replacing the fastener; and reconnecting the biasing mechanism between the first plate and the second plate.

13. A method of permanently fixing the collar insert of claim 1 in the first plate, the method comprising:

selecting a collar insert having a flange extending outwardly in the plane of first plate from the outer diameter of the collar insert;

forming a hole in the first plate having a diameter selected to fit the flange of the collar insert into the hole; and joining the flange of the collar insert to the hole in the first plate.

14. The method of claim 13, wherein the step of joining includes welding the flange of the insert collar in the first plate.

15. The method of claim 14, wherein the welding is friction stir welding.

16. The method of claim 13, wherein the step of joining includes brazing the flange of the insert collar in the first plate.

* * * * *